United States Patent [19]

Hlinka et al.

[11] 4,202,397

[45] May 13, 1980

[54] METHOD OF CONTINUOUSLY CASTING MOLTEN METAL

[75] Inventors: Joseph W. Hlinka; Bruce C. Whitmore; Mustafa R. Ozgu, all of Bethlehem, Pa.

[73] Assignee: Bethlehem Steel Corporation, Bethlehem, Pa.

[21] Appl. No.: 542,480

[22] Filed: Jan. 20, 1975

[51] Int. Cl.[2] ..... B22D 11/10

[52] U.S. Cl. ..... 164/82; 164/437

[58] Field of Search ..... 164/82, 135, 281, 273 R, 164/437, 439

[56] References Cited

U.S. PATENT DOCUMENTS

| | | | |
|---|---|---|---|
| 3,050,793 | 8/1962 | Tragner et al. | 164/156 |
| 3,517,726 | 6/1970 | Mills et al. | 164/281 X |

FOREIGN PATENT DOCUMENTS

| | | | |
|---|---|---|---|
| 1802884 | 6/1970 | Fed. Rep. of Germany | 164/281 |
| 1492871 | 8/1967 | France | 164/281 |
| 221233 | 9/1968 | U.S.S.R. | 164/437 |

*Primary Examiner*—Robert D. Baldwin
*Assistant Examiner*—Gus T. Hampilos
*Attorney, Agent, or Firm*—John I. Iverson

[57] ABSTRACT

A method of introducing molten metal, especially steel into a rectangular, open-ended continuous casting mold. The method is especially suitable for the continuous casting of high quality steel blooms and billets. The molten metal is introduced beneath the surface of a pool of molten metal contained in the mold from a submerged pouring nozzle as four fixed streams oriented with respect to the mold walls so as to produce a circulatory flow of molten metal around the perimeter of the mold.

2 Claims, 2 Drawing Figures

METHOD OF CONTINUOUSLY CASTING MOLTEN METAL

BACKGROUND OF THE INVENTION

This invention relates to the continuous casting of molten metals and more particularly to a method of introducing the molten metal into an open-ended continuous casting mold using a submerged pouring nozzle. The use of refractory pouring tubes or nozzles to introduce molten metal into a continuous casting mold is well known having been developed for the continuous casting of non-ferrous metals in the 1940's and then with the development of improved refractories, applied to the continuous casting of ferrous metals, especially steel, in the 1960's.

The primary purpose of the pouring nozzle is to protect the molten metal from oxidation as it was being cast. In the early nozzles, the molten metal was usually introduced essentially downward into the mold by a single discharge port or by a bifurcated pouring nozzle positioned beneath the surface of the molten metal contained in the mold. As example of such a nozzle is described in U.S. Pat. No. 3,371,704. Such nozzles, while reducing oxidation of the molten metal, did not completely solve the major problem of preventing oxide particles and other objectionable inclusion materials that might be present into the molten metal from being deposited near or in the surfaces of the solidifying casting and thereby becoming surface imperfections or defects in the finished casting. A major step in the solution of this problem evolved with the development of the process described in U.S. Pat. No. 3,517,726 in which the molten metal is introduced beneath the surface of the metal in the mold through controlled streams having an upwardly and outwardly flowing component which contacts the solidifying casting surfaces to wash away objectionable inclusion materials to the center of the surface of the pool of metal where they can be readily removed. This practice when applied to the continuous casting of large rectangular steel slabs significantly improved the quality of such slabs when compared to slabs cast using the earlier single port and bifurcated port nozzles.

While the practice described in U.S. Pat. No. 3,517,726 solved the problem of surface inclusions for large rectangular steel slabs, the practice did not result in consistently good results when applied to the casting of steel blooms and billets where the mold section is of smaller dimension than a slab mold section and is usually square or rectangular but having side walls not significantly greater in dimension than the end walls of the mold.

SUMMARY OF THE INVENTION

It is therefore an object of this invention to provide a method of introducing molten metal from a submerged pouring nozzle into a rectangular continuous casting mold which prevents objectionable oxides and inclusion materials from forming in or near the surface of billets and blooms.

It is a further object of this invention to provide a method of producing steel billets and blooms of a consistently high quality.

Other and further objects of this invention will become apparent from the following description and the accompanying drawings and claims.

It has been discovered the foregoing objects can be attained by introducing at least four cooperating fixed streams of molten metal into the rectangular continuous casting mold, below the surface of the pool of molten metal maintained in the upper end of the mold, with each of the streams being directed obliquely toward the mold wall and cooperating with each other to produce a circulatory flow of molten metal in the upper portion of the molten metal pool.

DESCRIPTION OF PREFERRED EMBODIMENT

Figure 1:
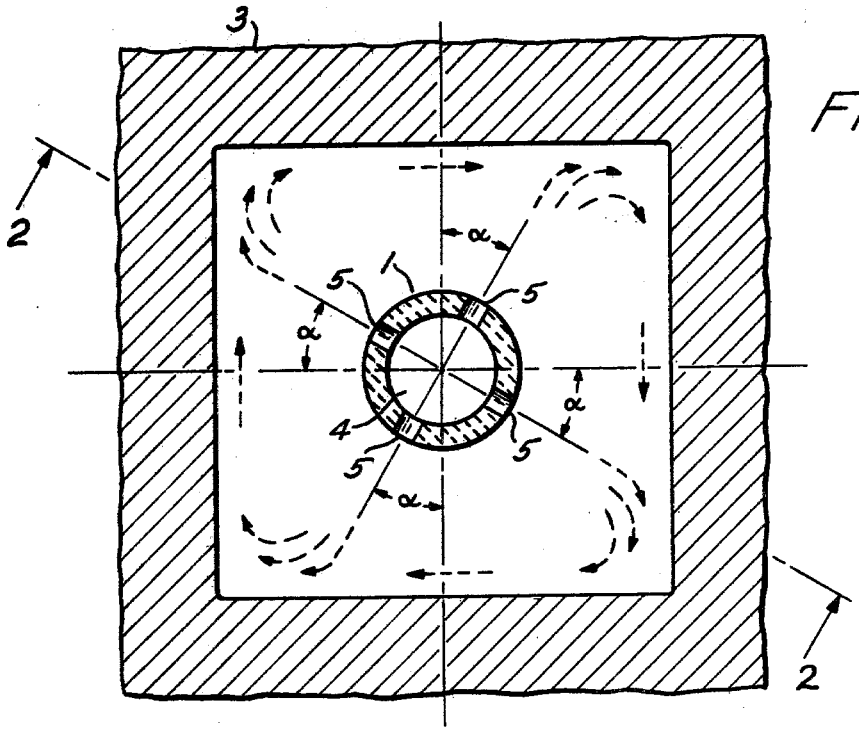
FIG. 1 is a horizontal sectional view of the continuous casting pouring nozzle of this invention disposed in a rectangular open-ended continuous casting mold.

FIG. 1 illustrates a cylindrical refractory pouring nozzle 1 disposed in a pool of molten metal 2 contained in the upper end of a rectangular open-ended continuous casting mold 3. The pouring nozzle 1 is attached at its upper end to a molten metal supply source (not shown) such as a tundish and is closed at its lower end 4. The pouring nozzle used in this invention is provided with four orifices or discharge ports 5 drilled in the sidewall of the pouring nozzle 1 preferably 90° apart from each other and near the closed end 4 of pouring nozzle 1.

The pouring nozzle 1 is preferably made of fused silica or other refractory material that is capable of withstanding not only the high temperatures and erosion associated with molten metals but also resistant to thermal shock.

Figure 2:
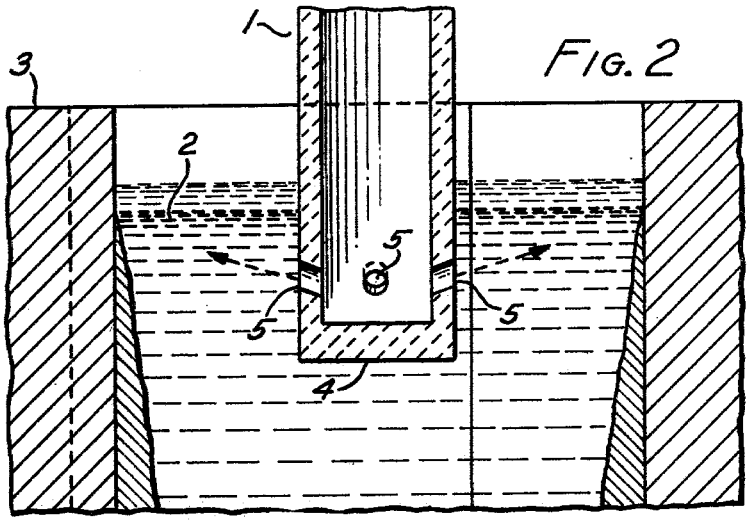
FIG. 2 is a fragmentary vertical sectional view of a continuous casting pouring nozzle of this invention taken along sectional lines 2—2 of FIG. 1.

As best shown in FIG. 2, the discharge ports 5 are preferably angled upwardly, which angle may vary depending on the size of the mold, the size of the pouring nozzle and ports, the depth of immersion of the pouring nozzle ports in the molten metal pool, the casting speed, and is chosen so that streams of molten metal discharged from the ports 5 are directed to the sidewalls of the mold at or near the surface of the molten metal pool as taught in U.S. Pat. No. 3,517,726, and indicated by the arrows in FIG. 1.

FIG. 1 illustrates the preferred orientation of the pouring nozzle and discharge ports 5 when used with the method of this invention in a square or almost square open-ended continuous casting mold 3. As shown in the sectional view of FIG. 1, the four discharge ports 5 are positioned within the mold 3, so that the streams of molten metal discharged from the ports 5 are not directed either to the midpoints of the mold walls or to the corners of the mold but are directed at an oblique angle $\alpha$ to the mold walls and strike the mold wall at a point somewhat between the midpoint of the mold wall and its corners.

As further illustrated by FIG. 1, such an orientation produces a circulating flow of molten metal around the perimeter of the mold in the upper portion of the molten metal pool 2. It has been discovered that such an orientation and circulating flow removes the objectionable oxides and other non-metallic inclusion materials from the solidifying surfaces of the casting, including the corners, and results in castings having superior surface and subsurface quality when compared to castings produced by directing the molten metal directly at the mold walls or to the corners.

The orientation angle $\alpha$ required to obtain this important circulating flow of molten metal will vary somewhat according to the mold dimensions but in general will vary between 15°–43° with respect to a perpendicular plane at the midpoint of the mold wall. Table 1 sets forth the range of angle $\alpha$ for various sized molds as well as the preferred angle to give the desired circulation.

TABLE I

| Ratio of Mold Width to Thickness | Discharge Port Orientation Angle in Degrees | Preferred Discharge Port Orientation Angle in $\alpha$ Degrees |
|---|---|---|
| 1.0 | 15–43 | 30 |
| 1.23 | 15–43 | 30 |
| 1.5 | 15–33 | 20 |
| 2.0 | 20–43 | 30 |

The method of this invention is only applicable to rectangular molds where the ratio of the mold side width to the mold end thickness is substantially between one to one and one to two, and thus is primarily useful for the continuous casting of square or almost square billets and blooms.

The effect of pouring nozzle orientation and circulating molten metal flow patterns were first studied and developed in transparent water models and then tried in experimental casts of steel blooms. It was observed that each of the streams when oriented according to our invention augment and cooperate with each other to provide the desirous circulatory movement. At no point will the streams tend to counteract each other as was the case in the prior art practices.

A specific example of this invention involved the continuous casting of molten steel into a 8 inch ×8 inch open ended water cooled mold at a rate of about 80 inches per minute. The pouring nozzle was a 2 inch I.D., 4½ inch O.D., fused silica tube with a closed end. Four 1 inch diameter ports, submerged 3–5 inches below the surface of the pool of molten metal, introduced the molten metal from the pouring nozzle into the mold. The discharge ports were oriented at an angle $\alpha$ of 30° to a perpendicular plane at the midpoint of each of the mold walls and directed 15° upwards from the horizontal plane.

Table II below sets forth the effects of the prior art and this invention on the surface quality of continuously cast 8 inch ×8 inch steel blooms.

TABLE II

| Number of Discharge Ports | Port Orientation | Avg. Rating* |
|---|---|---|
| 1 (prior art) | vertically downward | 2.61 |
| 4 (prior art) | = 0° | .66 |
| 4 | = 30° | .37 |

*Number of surface defects observed per square foot of surface.

It can readily be seen from Table II the 30° angle $\alpha$ discharge according to this invention produced a bloom having a significantly cleaner surface than blooms produced using pouring nozzles of the prior art.

We claim:

1. A process for the continuous casting of moten metal into billets or blooms comprising:

introducing a submergible nozzle having a central longitudinal axis into a vertically oriented rectangular open-ended continuous casting mold, said submergible nozzle being provided with at least four nozzle outlets radially disposed from said central longitudinal axis and said open-ended continuous casting mold being dimensioned such that, in horizontal cross section, the ratio of the lengths of one opposed pair of mold walls to the lengths of the other opposed pair of mold walls is approximately between one to one and one to two;

introducing molten metal into said nozzle and through said nozzle outlets to establish at least four cooperating fixed streams of molten metal below the surface of a pool of molten metal continuously maintained in said mold with at least one stream being directed toward each mold wall, each nozzle being designed such that each of said streams is directed in a substantially straight line obliquely toward a mold wall and each nozzle outlet being angled from between 15°–43° with respect to a plane perpendicular to the mold wall to be impinged by the stream flowing from a particular nozzle and passing through the midpoint of the length of the mold wall to be impinged so that each of the streams strikes a mold wall in that portion of the mold wall between the midpoint of the length of the mold and wall adjacent corner, whereby the streams cooperate to produce a non-interfering unidirectional circulatory flow of molten metal circumferentially along the perimeter of said mold in the upper portion of said molten metal pool.

2. The process of claim 1 in which each of said molten metal streams is directed upwardly toward the surface of said molten metal pool.

* * * * *